US005782099A

United States Patent [19]

Hoshino et al.

[11] Patent Number: 5,782,099

[45] Date of Patent: Jul. 21, 1998

[54] METHOD FOR CONTROLLING AN ABSORPTION SYSTEM

[75] Inventors: Toshiyuki Hoshino; Masayuki Oonou, both of Ohra-gun; Goro Ebara, Isesaki; Hideo Ishiko, Ohra-gun; Masahiko Ikemori, Ohta, all of Japan

[73] Assignee: Sanyo Electric Co., Ltd., Osaka-fu, Japan

[21] Appl. No.: 667,940

[22] Filed: Jun. 24, 1996

[30] Foreign Application Priority Data

Jun. 27, 1995 [JP] Japan ..... 7-160936

[51] Int. Cl.[6] ..... F25B 15/00; F25B 49/00

[52] U.S. Cl. ..... 62/148

[58] Field of Search ..... 62/141, 148, 103, 62/476, 497

[56] References Cited

U.S. PATENT DOCUMENTS

| | | | |
|---|---|---|---|
| 3,195,318 | 7/1965 | Miner | 62/148 |
| 3,426,548 | 2/1969 | Greacen et al. | 62/148 |
| 3,575,008 | 4/1971 | Lorenz | 62/103 |
| 3,590,593 | 7/1971 | Miner | 62/148 |
| 3,837,174 | 9/1974 | Miyagi et al. | 62/141 |
| 4,164,128 | 8/1979 | Newton | 62/105 |

*Primary Examiner*—William Doerrler

*Attorney, Agent, or Firm*—Weingarten, Schurgin, Gagnebin & Hayes LLP

[57] ABSTRACT

A method for controlling an absorption system, comprising the step of performing slow open control for opening a control valve of a heat-source fluid feeding pipe connected to a regenerator at a predetermined speed and controlling the heat input at the time of start; wherein said control valve is quickly opened up to a predetermined opening degree at the time of start and thereafter, said control valve is opened at said predetermined speed is provided. There is no loss in the starting time by improving an operation delay of a heat-source fluid control valve at the start of operations and it is prevented that the heat-source fluid is excessively supplied to the absorption system itself which has still a low temperature to affect an equipment-side boiler even after the valve fully opens. When a start switch is operated, a controller 30 controls a motor 37 for opening/closing the control valve 36 so as to quickly increase the opening degree of the control valve 36 up to 20%, thereafter increase the opening degree at an opening speed of 50%/min until the opening degree reaches 70%, and opens the control valve at a low speed of 7%/min up to 100% after the opening degree exceeds 70%. Therefore, overshoot is prevented and any trouble does not occur that the water vapor excessively enters a high-temperature regenerator 1 though high-temperature high-pressure water vapor is quickly supplied to the regenerator 1.

9 Claims, 4 Drawing Sheets

METHOD FOR CONTROLLING AN ABSORPTION SYSTEM

BACKGROUND OF THE INVENTION

1. Field of the Invention

The present invention relates to a method for controlling an absorption system, particularly to a method for controlling heat input for feeding heat source fluid such as high-temperature high-pressure water vapor to a regenerator for evaporation-separating a refrigerant in an absorption system.

2. Background Art

In an absorption system having a refrigerating cycle formed by connecting a regenerator, a condenser, an evaporator, and an absorber to each other by pipes, the so-called slow open control in which a control valve of a heat-source fluid feeding pipe connected to the regenerator is slowly opened for approx. 10 min as shown in FIG. 6 is performed so that water vapor does not excessively enter a cold canister at the time of start when using high-temperature high-pressure water vapor as the heat source of the regenerator.

In the case of the conventional control method at the time of start, however, there is a loss in the starting time because there is a range ability due to the characteristic of the control valve and an initial operational delay due to a tightening margin. Moreover, there is a problem that, even after the control valve fully opens, excessive water vapor enters an equipment-side boiler to affect the boiler because the temperature of the system and that of a solution are low and this point is a problem to be solved.

SUMMARY OF THE INVENTION

To solve the above problems of the prior art, the present invention provides a method for controlling an absorption system having a refrigerating cycle formed by connecting a regenerator, a condenser, an evaporator, and an absorber to each other by pipes; comprising the step of performing slow open control for opening a control valve of a heat-source fluid feeding pipe connected to the regenerator at a predetermined speed so as to limit the heat input at the time of start; wherein the control valve is quickly opened up to a predetermined opening degree at the time of start and thereafter, the control valve is opened at the predetermined speed.

Moreover, to solve the above problems, the present invention provides a method for controlling an absorption system having a refrigerating cycle formed by connecting a regenerator, a condenser, an evaporator, and an absorber to each other by pipes; comprising the step of performing slow open control for opening a control valve of a heat-source fluid feeding pipe connected to the regenerator at a predetermined speed so as to limit the heat input at the time of start; wherein the control valve is fixed to an opening degree in which the heat-source fluid does not flow exceeding 100% of the rating under the normal operation state to start feed of the heat-source fluid to the regenerator and thereafter, the control valve is opened so that the flow rate of the heat-source fluid is not decreased.

Furthermore, to solve the above problems, the present invention provides a method for controlling an absorption system having a refrigerating cycle formed by connecting a regenerator, a condenser, an evaporator, and an absorber to each other by pipes; comprising the step of performing slow open control for opening a control valve of a heat-source fluid feeding pipe connected to the regenerator at a predetermined speed so as to limit the heat input at the time of start; wherein the control valve is quickly opened up to a predetermined opening degree at the time of start, the opening degree is maintained until the temperature of the regenerator reaches a predetermined value, and the control valve is opened at the predetermined speed after the temperature of the regenerator exceeds the predetermined value. Furthermore, said predetermined speed can be set in accordance with the temperature of the regenerator.

Furthermore, the present invention provides a method for controlling an absorption system as set forth above, wherein the opening speed of the control valve may be decreased as the temperature of cooling water lowers in accordance with the temperature of the cooling water entering the absorber and the condenser.

Furthermore, the present invention provides a method for controlling an absorption system as set forth above, wherein the control valve of the heat-source fluid feeding pipe connected to the regenerator can be controlled in accordance with a smaller opening degree between an opening degree obtained in accordance with the temperature of a thermal operation fluid cooled by and taken out of the evaporator and an opening degree obtained in accordance the temperature of the regenerator.

According to the above-described present invention, because the control vale set to the heat-source fluid feeding pipe is constituted so that the valve quickly opens up to a predetermined opening degree and thereafter, opens at a predetermined speed, there is no loss in the starting time, overshoot is prevented while quickly feeding heat-source fluid, and it is avoided that the heat-source fluid is excessively flown.

Moreover, because the control valve is constituted so that the valve is fixed to a proper opening degree in which no heat-source fluid flows exceeding 100% of the rating to start feed of the heat-source fluid to the regenerator and slowly opens to prevent the flow rate of the heat-source fluid from decreasing, the heat-source fluid does not excessively enter the regenerator even when the temperature of the regenerator is low and any trouble can be avoided that the flow rate of the heat-source fluid to be fed to the regenerator decreases even if the regenerator temperature rises.

Furthermore, because the control valve is constituted so that the valve quickly opens up to a predetermined opening degree, maintains the opening degree until the temperature of the regenerator reaches a predetermined value, and opens at a predetermined speed after the temperature of the regenerator exceeds a predetermined value, or the valve opens at a predetermined speed in accordance with the temperature of the regenerator, there is no loss in the starting time, overshoot is prevented while quickly feeding heat-source fluid, and it is avoided that the heat-source fluid is excessively supplied.

Furthermore, though, when the temperature of cooling water to be fed to the absorber and the condenser lowers, condensation of a refrigerant in the condenser is accelerated and thereby, evaporation-separation of the refrigerant in the regenerator is accelerated, and the refrigerant is easily evaporated, it is possible to control the opening degree of a control valve more accurately because the valve is constituted so as to decrease the opening speed as the temperature of cooling water lowers.

Furthermore, because the control valve of the heat-source fluid feeding pipe connected to the regenerator is constituted so that the valve is controlled in accordance with a smaller opening degree between an opening degree obtained in accordance with the temperature of thermal operation fluid cooled by and taken out of the evaporator and an opening degree obtained in accordance with the temperature of the regenerator, it is possible and profitable to take cold water at a predetermined temperature out of the evaporator while reducing the consumption of heat-source fluid.

DETAILED DESCRIPTION OF THE PREFERRED EMBODIMENTS

An embodiment of the present invention will be described below more minutely by referring to the accompanying drawings.

Figure 5:
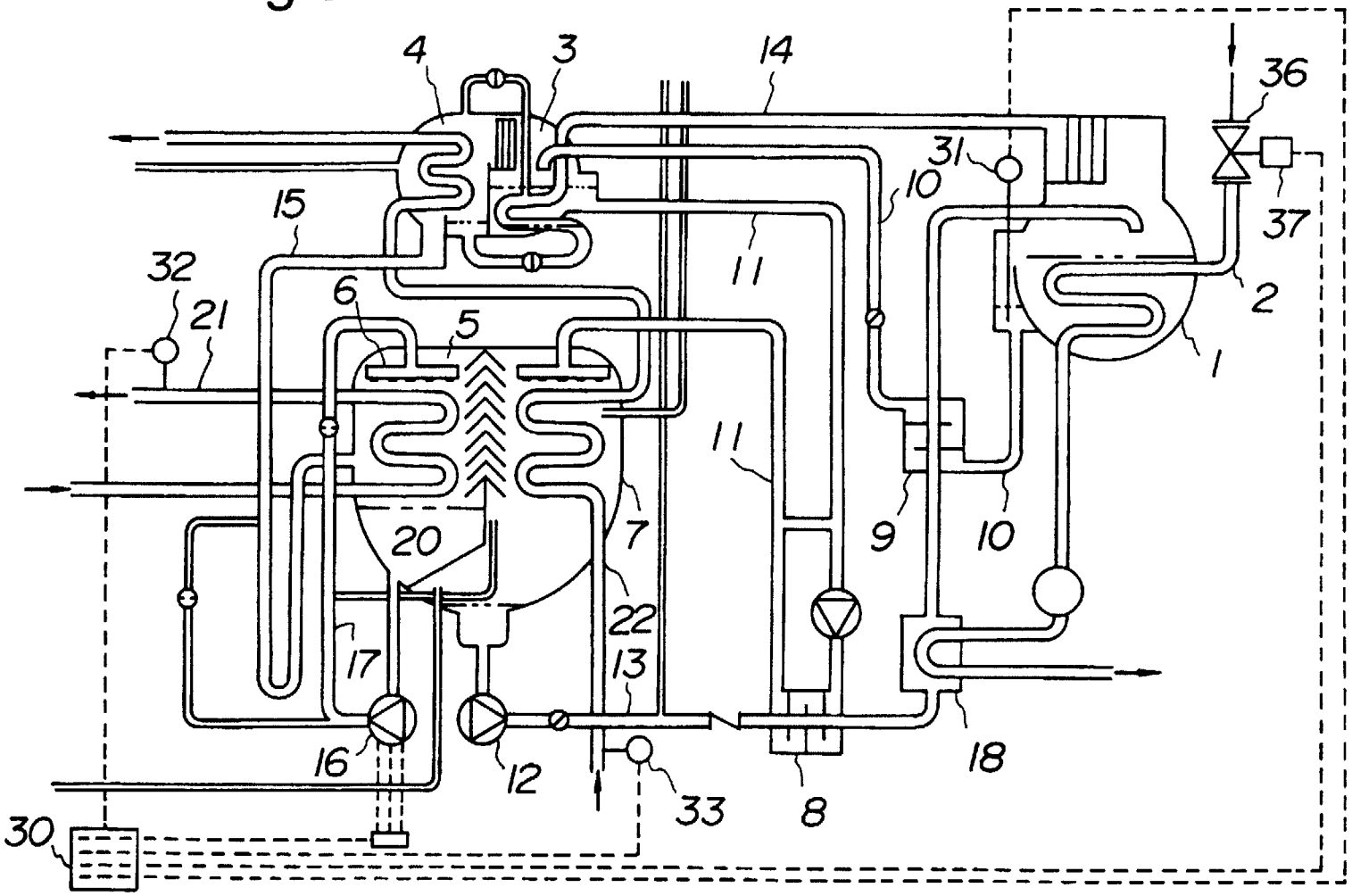
FIG. 5 is an illustration showing the structure of an embodiment according to the present invention.
Figure 6:
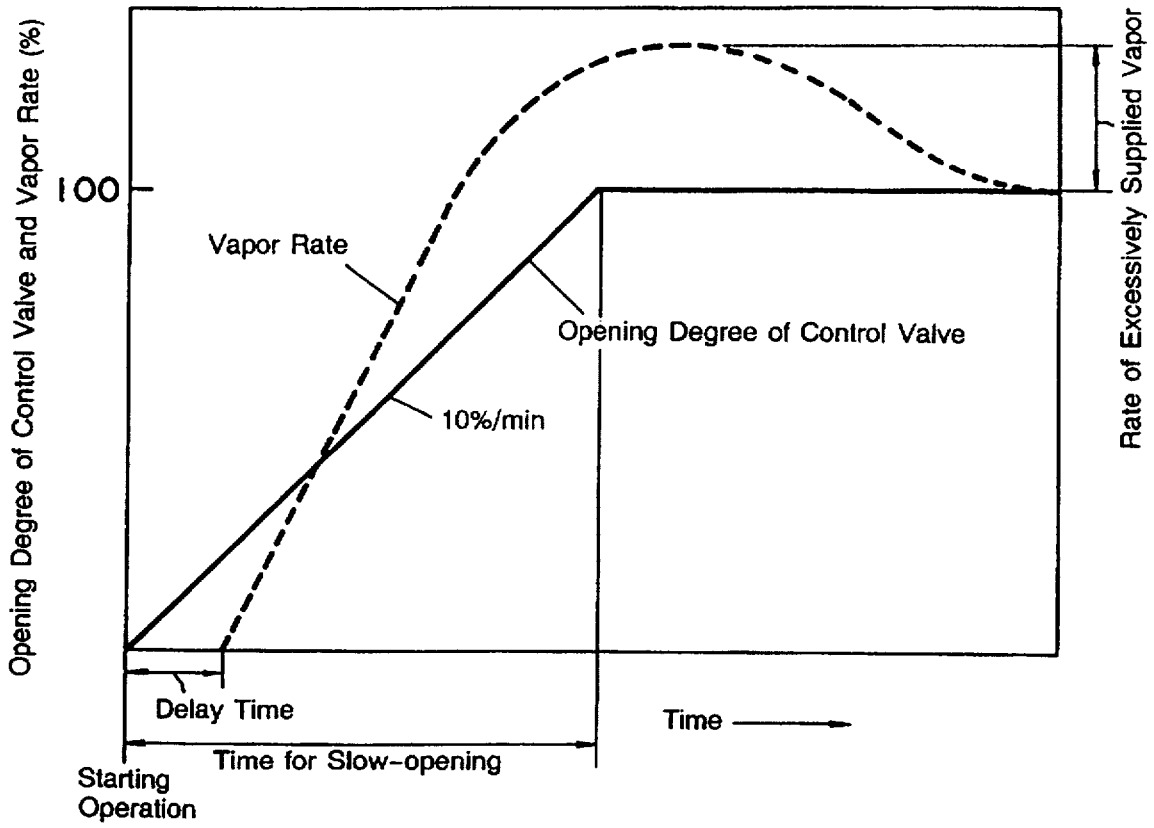
Fig.6 Prior Art
FIG. 6 is an illustration of the prior art.

FIG. 5 is a schematic block diagram of an absorption system using water as a refrigerant and lithium bromide (LiBr) solution as an absorbent (solution). In FIG. 5, numeral 1 represents a high-temperature regenerator and a heat-source fluid feeding pipe 2 for feeding heat-source fluid such as high-temperature high-pressure water vapor is arranged through the inside of the regenerator wherein refrigerant vapor is produced by heating a diluted solution to condense the solution to an intermediate solution. Numeral 3 represents a low-temperature regenerator for changing the intermediate solution to a condensed solution by heating the intermediate solution by the refrigerant vapor, numeral 4 represents a condenser for cooling and condensing the refrigerant vapor fed from the low-temperature regenerator 3, numeral 5 represents an evaporator for evaporating the refrigerant by spraying or dripping it from a refrigerant distributor 6, numeral 7 represents an absorber for making the condensed solution fed from the low-temperature regenerator 3 absorb the refrigerant incoming from the evaporator to keep the pressure in the absorber low, numeral 8 represents a low-temperature heat exchanger, and numeral 9 represents a high-temperature heat exchanger. These units are connected by an intermediate-solution pipe 10, a condensed-solution pipe 11, a diluted-solution pipe 13 having an absorbent pump 12, a refrigerant conduit 14, a refrigerant pipe 15, and a refrigerant circulation pipe 17 having a refrigerant pump 16 to form a main circulation cycle for the refrigerant and the absorbent. Moreover, a heat recovery system 18 is connected by pipes as shown in FIG. 5, in which thermal operation fluid cooled due to the latent heat of vaporization of the refrigerant such as cold water can cyclically be fed to a predetermined indoor heat exchanger (not illustrated) serving as a refrigerating load by, for example, a cold water pipe 21 through the wall of a heat transfer pipe 20 arranged in the evaporator 5. Moreover, numeral 22 represents a cooling water pipe arranged through the inside of the absorber 7 and condenser 4. The above structure is already known to the public.

Numeral 30 represents a controller for the absorption system having the above structure. The controller is provided with a function for performing slow open control in which a control valve 36 is slowly opened in accordance with a solution temperature $T_1$ measured by a temperature sensor 31 set to the high-temperature regenerator 1 at the time of start of the system when the temperature of the high-temperature regenerator 1 is not adequately raised and a capacity control function for controlling the flow rate of high-temperature high-pressure water vapor to be fed to the high-temperature regenerator 1 by controlling the opening degree of the control valve 36 set to the heat-source fluid feeding pipe 2 so that the temperature $T_2$ of cold water at the outlet of the evaporator 5 measured by a temperature sensor 32 set to the cold water pipe 21 at the outlet of the evaporator 5 is kept at a predetermined value such as 7° C. The capacity control is performed preferentially to the slow open control.

Figure 1:
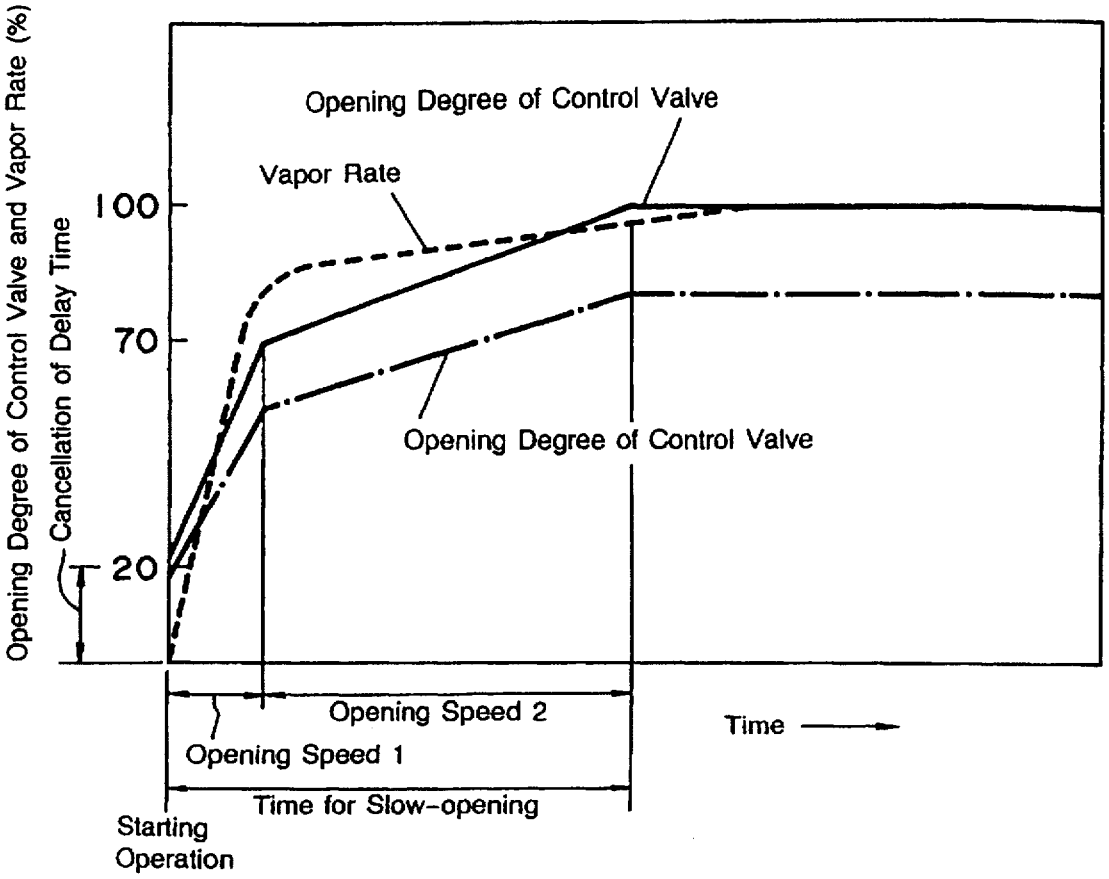
FIG. 1 is an illustration showing a procedure for controlling a heat-source fluid control valve according to the present invention.

Specifically, the controller 30 stores the relation between the opening degree of the control valve 36 when starting the absorption system and the elapsed time after starting the system in a memory (not shown) as shown by the continuous line in FIG. 1 and it is constituted to control the opening degree of the control valve 36 by outputting a predetermined number of steps properly to a motor 37 from the controller 30 so that the control valve 36 slowly opens with the elapse of time.

Therefore, the opening degree of the control valve 36 is first quickly increased to 20% by the motor 37 controlled by the controller 30 when a starting switch (not shown) is operated and thereafter, it is increased at an opening speed of 50%/min until the opening degree of the control valve 36 reaches 70%. After the opening degree exceeds 70%, the valve 36 slowly opens at an opening speed of 7%/min and the opening degree reaches 100%. Therefore, high-temperature high-pressure water vapor is quickly fed to the high-temperature regenerator 1 as shown by the broken line in FIG. 1, but any trouble does not occur that the water vapor is excessively supplied to the regenerator due to overshoot.

Moreover, since the controller 30 performs the capacity control preferentially to the slow open control as described above, when the cold water temperature $T_2$ measured by the temperature sensor 32 lowers to a predetermined value (in this case, 7° C.) during the slow open control, the opening degree of the control valve 36 is controlled so that the cold water temperature $T_2$ measured by the temperature sensor 32 is kept the predetermined value even if the opening degree of the control valve 36 does not reach 100%.

Furthermore, even if the state of high-temperature high-pressure water vapor passing through the control valve does not change, the quantity of heat discharged to the solution in the high-temperature regenerator 1 increases and the pressure lowering width at the downstream side of the control valve 36 increases when the solution temperature $T_1$ of the high-temperature regenerator 1 measured by the temperature sensor 31 is low. Therefore, the flow rate of the high-temperature high-pressure water vapor to be fed to the high-temperature regenerator 1 increases. However, when the solution temperature $T_1$ rises, the quantity of heat discharged to the high-temperature regenerator 1 decreases and the pressure lowering width decreases at the downstream side of the control valve 36. Therefore, the flow rate of the high-temperature high-pressure water vapor tends to decrease.

That is, there are some control valves 36 in which, even if the opening degree of the valve is set to, for example, 70%, high-temperature high-pressure water vapor flows up to approx. 100% of the rating except the time of starting when the solution temperature $T_1$ of the high-temperature regenerator 1 is lower than 130° C. and the flow rate slowly decreases as the temperature rises when the solution temperature $T_1$ reaches 130° C. or higher.

Figure 2:
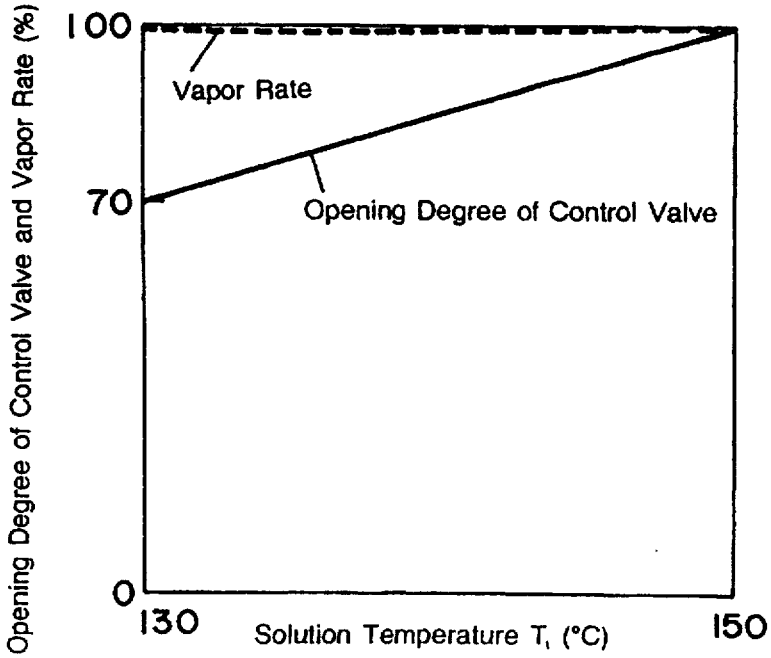
FIG. 2 is an illustration showing another procedure for controlling a heat-source fluid control valve according to the present invention.

For example, as shown in FIG. 2, the control valve 36 having the above flow-rate characteristic can be controlled so that high-temperature high-pressure water vapor exceeding the rating does not enter the high-temperature regenerator 1 while quickly supplying the water vapor to the regenerator 1 by fixing the opening degree of the control valve 36 to 70% when the solution temperature $T_1$ of the high-temperature regenerator 1 measured by the temperature sensor 31 is lower than 130° C., increasing the number of steps to be supplied to the motor 37 in accordance with the solution temperature $T_1$ when the temperature $T_1$ is 130° C. or higher, and slowly opening the control valve 36 as shown in FIG. 2.

Figure 3:
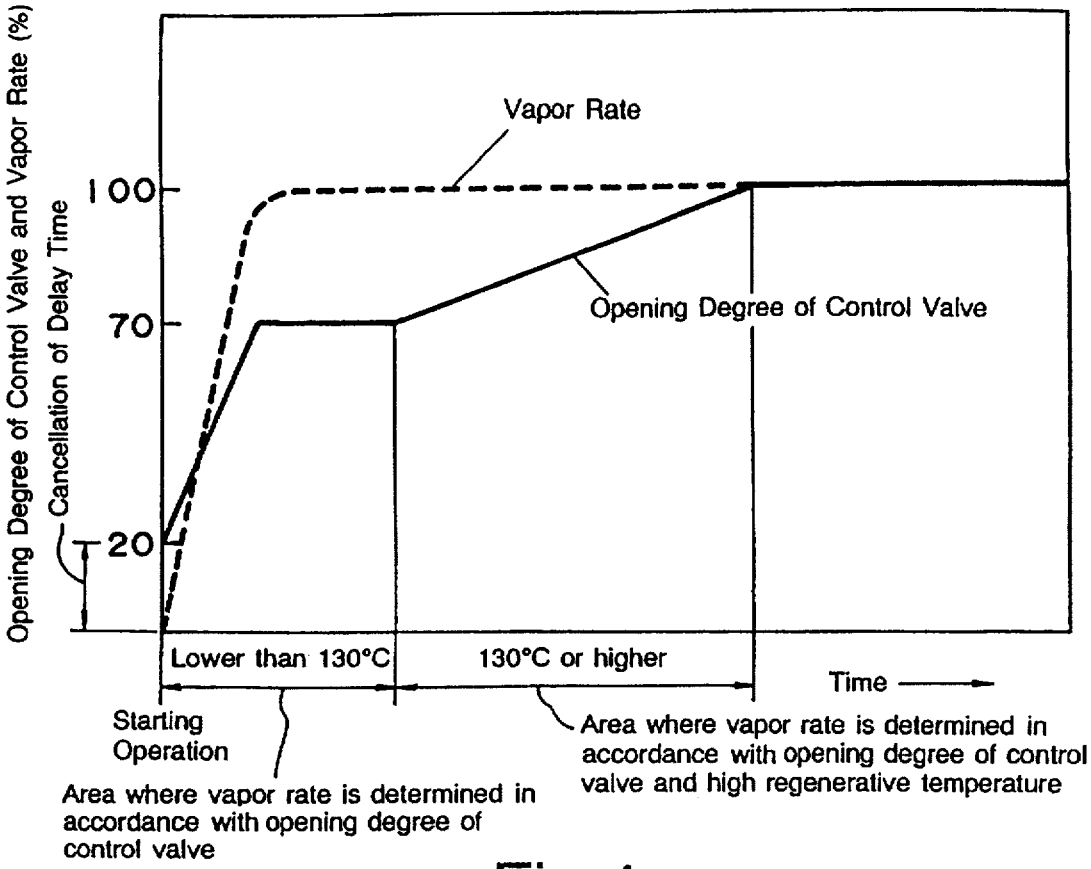
FIG. 3 is an illustration showing still another procedure for controlling a heat-source fluid control valve according to the present invention.

Moreover, as shown in FIG. 3, the controller 30 can be constituted so as to first quickly increase the opening degree of the control valve 36 by the motor 37 controlled by the controller 30 when a start switch is operated, open the valve at an opening speed of 50%/min until the opening degree of the control valve 36 reaches 70%, then fix the opening degree to 70% until the solution temperature $T_1$ of the high-temperature regenerator 1 measured by the temperature sensor 31 reaches a predetermined temperature such as 130° C., and thereafter slowly increase the opening degree up to 100% at an opening speed of 7%/min.

Thus, also by controlling the opening degree of the control valve 36, overshoot is prevented and high-temperature high-pressure water vapor does not excessively enter the high-temperature regenerator 1 though the water vapor quickly increases as shown by the broken line in FIG. 3.

Moreover, it is possible to constitute the controller 30 shown in FIG. 3 for increasing the opening degree of the control valve 36 from 70 to 100% so as to increase the opening degree not at a constant pace but in accordance with the solution temperature $T_1$ measured by the temperature sensor 31 in the control by the controller 30.

Even by controlling the opening degree of the control valve 36 as described above, overshoot is prevented and high-temperature high-pressure water vapor does not excessively enter the regenerator 1 though the water vapor quickly increases.

Moreover, when the temperature of cooling water passing through the cooling water pipe 22 and entering the absorber 7 and condenser 4 lowers, condensation of the refrigerant in the condenser 4 is accelerated and thereby, evaporation-separation of the refrigerant in the high-temperature regenerator 1 is accelerated. Therefore, it is necessary to decrease the opening degree of the control valve 36 set to the heat-source fluid feeding pipe 2. However, when the temperature of the cooling water rises, evaporation-separation of the refrigerant in the high-temperature regenerator 1 is not accelerated. Therefore, it is necessary to increase the opening degree of the control valve 36.

Figure 4:
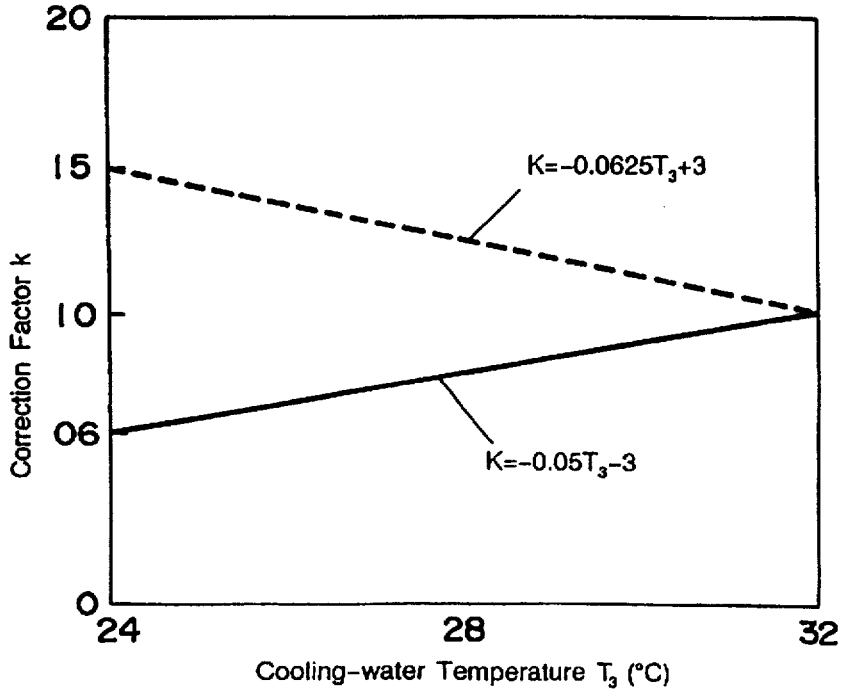
FIG. 4 is an illustration showing a procedure for setting a correction factor k.

Therefore, it is also possible to constitute the controller 30 so as to control the opening degree of the control valve 36 by setting the correction factor k, for example, as shown by the continuous line in FIG. 4 in accordance with a cooling water temperature $T_3$ measured by a temperature sensor 33 set to the inlet of the absorber of the cooling water pipe 22 while performing correction by using the correction factor k obtained from the cooling water temperature $T_3$ measured for each predetermined time (e.g. 1 min) by the temperature sensor 33.

For example, in the case of the controller 30 for controlling the opening degree of the control valve 36 as the continuous line in FIG. 1, the correction factor k is obtained as 0.8 from FIG. 4 when the cooling water temperature $T_3$ measured by the temperature sensor 33 is 28° C. Therefore, it is possible to perform more accurate control by constituting the controller 30 so that the control valve 36 is controlled at an opening degree obtained multiplied by the value 0.8, that is, the opening degree shown by the one dot chain line in FIG. 4.

Thus, by controlling the opening degree of the control valve 36 while including the cooling water temperature $T_3$, more accurate control is realized.

For the capacity control under the normal operation, in which the opening degree of the control valve 36 set to the heat-source fluid feeding pipe 2 is controlled so as to keep the cooling water temperature $T_2$ at the outlet of the evaporator measured by the temperature sensor 32 at a predetermined value such as 7° C., it is also possible to constitute the controller 30 so as to control the opening degree of the control valve 36 in accordance with a smaller opening degree between an opening degree of the control valve 36 computed in accordance with the cooling water temperature $T_2$ measured by the temperature sensor 32 and an opening degree of the control valve 36 computed in accordance with the solution temperature $T_1$ measured by the temperature sensor 31.

By constituting the controller 30 as described above, it is possible to cyclically feed cooling water at a predetermined temperature to a refrigerating load (not shown) through the cooling water pipe 20 while reducing the consumption of high-temperature high-pressure water vapor.

The present invention is not restricted to the above embodiments. Various modifications can be made as long as they are not deviated from the gist described in claims.

For example, when setting the correction factor k as the broken line in FIG. 4, the controller 30 is constituted so as to control the control valve 36 to an opening degree obtained by dividing an opening degree by the correction factor k (for example, an opening degree divided by 1.25 when the cooling water temperature $T_3$ is 28° C.). Thus, an arithmetic method for correction depends on the way of setting a correction factor k. Therefore, it is possible to constitute the controller 30 so as to perform correction by the subtraction/addition method depending on the way of setting a correction factor k.

[Advantages of the invention]

As described above, according to the present invention, the control valve set to the heat-source fluid feeding pipe is constituted so that the valve quickly opens up to a predetermined opening degree and thereafter opens at a predetermined low speed. Therefore, there is no loss in the starting time, overshoot is prevented while quickly feeding heat-source fluid, and it is avoided that the heat-source fluid is excessively supplied.

Moreover, because the control valve is constituted so that the valve is fixed to a proper opening degree in which no heat-source fluid flows exceeding 100% of the rating to start feed of the heat-source fluid to the regenerator and slowly opens to prevent the flow rate of the heat-source fluid from decreasing, the heat-source fluid does not excessively enter the regenerator even when the temperature of the regenerator is low and any trouble can be avoided that the flow rate of the heat-source fluid to be fed to the regenerator decreases even if the regenerator temperature rises.

Furthermore, because the control valve is constituted so that the valve quickly opens up to a predetermined opening degree, maintains the opening degree until the temperature of the regenerator reaches a predetermined value, and opens at a predetermined speed after the temperature of the regenerator exceeds a predetermined value, or the valve opens at a predetermined speed in accordance with the temperature of the regenerator, there is no loss in the starting time, overshoot is prevented while quickly feeding heat-source fluid, and it is avoided that the heat-source fluid is excessively supplied.

Furthermore, though, when the temperature of cooling water to be fed to the absorber and the condenser lowers, condensation of a refrigerant in the condenser is accelerated and thereby, evaporation-separation of the refrigerant in the regenerator is accelerated, and the refrigerant is easily evaporated, it is possible to control the opening degree of a control valve more accurately because the valve is constituted so as to decrease the opening speed as the temperature of cooling water lowers.

Furthermore, because the control valve of the heat-source fluid feeding pipe connected to the regenerator is constituted so that the valve is controlled in accordance with a smaller opening degree between an opening degree obtained in accordance with the temperature of thermal operation fluid cooled by and taken out of the evaporator and an opening degree obtained in accordance with the temperature of the regenerator, it is possible and profitable to take cold water at a predetermined temperature out of the evaporator while reducing the consumption of heat-source fluid.

What is claimed is:

1. A method for controlling an absorption system having a refrigerating cycle formed by connecting a regenerator, a condenser, an evaporator, and an absorber to each other in a circuit by pipes and controlling the heat input at the time of start, the method comprising the step of performing slow open control for opening a control valve of a heat-source fluid feeding pipe connected to said regenerator at a predetermined speed so as to limit the heat input at the time of start; wherein said control valve is quickly opened up to a predetermined opening degree and thereafter, said control valve is opened at said predetermined speed.

2. A method for controlling an absorption system having a refrigerating cycle formed by connecting a regenerator, a condenser, an evaporator, and an absorber to each other in a circuit by pipes and controlling the heat input at the time of start, the method comprising the step of performing slow open control for opening a control valve of a heat-source fluid feeding pipe connected to said regenerator at a predetermined speed so as to limit the heat input at the time of start; wherein said control valve is fixed to an opening degree in which said heat-source fluid does not flow exceeding 100% of the rating under the normal operation state to start feed of said heat-source fluid to said regenerator and thereafter, said control valve is opened so that the flow rate of said heat-source fluid is not decreased.

3. A method for controlling an absorption system having a refrigerating cycle formed by connecting a regenerator, a condenser, an evaporator, and an absorber to each other in a circuit by pipes and controlling the heat input at the time of start, the method comprising the step of performing slow open control for opening a control valve of a heat-source fluid feeding pipe connected to said regenerator at a sequence of predetermined speeds so as to limit the heat input at the time of start; wherein said control valve is quickly opened up to an initial opening degree thereafter a first predetermined speed of opening degree is maintained until a predetermined opening degree is reached, thereafter holding constant said opening degree until the temperature of said regenerator reaches a predetermined value, whereafter said control valve is opened at a second predetermined speed of opening degree after the temperature of said regenerator exceeds the predetermined value.

4. A method for controlling an absorption system according to claim 3, wherein said predetermined speed is set in accordance with the temperature of said regenerator.

5. A method for controlling an absorption system according to claim 1, wherein the predetermined speed of said control valve is decreased as the temperature of cooling water lowers in accordance with the temperature of said cooling water coming into said absorber and said condenser.

6. A control method for an absorption system having a refrigerating cycle formed by connecting a regenerator, a condenser, an evaporator, and an absorber to each other in a circuit by pipes and controlling the heat input under the normal operation except the time of start, the method comprising the step of opening or closing a control valve of a heat-source fluid feeding pipe connected to said regenerator to control heat input; wherein said control valve of said heat-source fluid feeding pipe connected to said regenerator s controlled in accordance with the differential between the temperature of a thermal operation fluid cooled by and taken out of said evaporator and the temperature of said regenerator.

7. A method for controlling an absorption system according to claim 2, wherein the predetermined speed of said control valve is decreased as the temperature of cooling water lowers in accordance with the temperature of said cooling water coming into said absorber and said condenser.

8. A method for controlling an absorption system according to claim 3, wherein the predetermined speed of said control valve is decreased as the temperature of cooling water lowers in accordance with the temperature of said cooling water coming into said absorber and said condenser.

9. A method for controlling an absorption system according to claim 4, wherein the predetermined speed of said control valve is decreased as the temperature of cooling water lowers in accordance with the temperature of said cooling water coming into said absorber and said condenser.

* * * * *